US007656145B2

(12) United States Patent
Xiao et al.

(10) Patent No.: US 7,656,145 B2
(45) Date of Patent: Feb. 2, 2010

(54) LOW POWER BANDGAP VOLTAGE REFERENCE CIRCUIT HAVING MULTIPLE REFERENCE VOLTAGES WITH HIGH POWER SUPPLY REJECTION RATIO

(75) Inventors: Sean Xiao, Shanghai (CN); Tom Tang, Shanghai (CN); Guoxing Li, Sunnyvale, CA (US)

(73) Assignee: O2Micro International Limited, Grand Cayman (KY)

( * ) Notice: Subject to any disclaimer, the term of this patent is extended or adjusted under 35 U.S.C. 154(b) by 394 days.

(21) Appl. No.: 11/820,349

(22) Filed: Jun. 19, 2007

(65) Prior Publication Data

US 2008/0315855 A1 Dec. 25, 2008

(51) Int. Cl.
*G05F 3/16* (2006.01)
*G05F 1/40* (2006.01)

(52) U.S. Cl. ..... 323/316; 323/280; 323/281

(58) Field of Classification Search ..... 323/312–316, 323/280, 281; 327/539, 540, 541
See application file for complete search history.

(56) References Cited

U.S. PATENT DOCUMENTS

| | | | | |
|---|---|---|---|---|
| 6,867,572 | B1 * | 3/2005 | Lin | 323/273 |
| 7,012,416 | B2 * | 3/2006 | Marinca | 323/316 |
| 7,233,196 | B2 * | 6/2007 | Farooqui | 327/541 |
| 7,420,359 | B1 * | 9/2008 | Anderson et al. | 323/316 |
| 2005/0110477 | A1 * | 5/2005 | Mauthe | 323/316 |

* cited by examiner

*Primary Examiner*—Jessica Han

(57) ABSTRACT

A voltage generator is used for generating a voltage reference with high power supply rejection. One embodiment of the circuit includes a voltage regulator and a bandgap voltage circuit and an amplifier. The voltage regulator including an input node is coupled to an external power supply for generating a regulated voltage source. A bandgap voltage circuit includes a first and a second resistor and a first and a second transistor to generate a voltage difference between the base-to-emitter voltages of the first and the second transistors. The second resistor is coupled to the first resistor and the first transistor for generating the first predetermined voltage in response to the voltage difference. An amplifier circuit is coupled to the first transistor of the bandgap voltage circuit for receiving a first amplifying signal and generating an amplified signal so as to regulate the regulated voltage source.

19 Claims, 7 Drawing Sheets

LOW POWER BANDGAP VOLTAGE REFERENCE CIRCUIT HAVING MULTIPLE REFERENCE VOLTAGES WITH HIGH POWER SUPPLY REJECTION RATIO

TECHNICAL FIELD

The present invention relates to bandgap voltage reference generators, and more particularly, to a low power bandgap voltage reference circuit having multiple reference voltages with a high power supply rejection ratio.

BACKGROUND ART

Reference circuits generate reference voltages used in a variety of semiconductor applications, including digital and analog devices. Maintaining the accuracy of these semiconductor applications is directly dependent on the stability of a reference voltage. A stable reference voltage immune to temperature variations, power supply variations and noise is required for high performance digital or analog components. For example, the conversion accuracy of signals from analog to digital and vice versa is directly dependent on accuracy of an internal reference which is typically a voltage reference which tolerates power supply variations and noise as well as temperature variations.

A typical solution to the internal voltage reference is a bandgap voltage reference or a bandgap circuit. Ideal bandgap voltage references provide a predetermined output voltage substantially invariant with respect to variations in temperature. The bandgap voltage reference is generated by adding the voltage of a forward-biased PN junction having a negative temperature coefficient to a voltage difference of two forward-biased base-emitter PN junctions having a positive temperature coefficient.

For example, a bandgap reference is disclosed in U.S. Pat. No. 5,512,817, and is shown in PRIOR ART FIG. 1. Referring to PRIOR ART FIG. 1, the bandgap voltage reference circuit comprises a current source, a simple bandgap voltage reference supply circuit 100 which can produce an output bandgap voltage $V_{BG}$, a high gain amplifier circuit 120 and a voltage regulator composed of a FET 142. The band gap voltage reference supply circuit 100 has virtually no power supply rejection ratio (PSRR), which is defined as the ratio of the change in external power supply $V_{DD}$ to the change in bandgap voltage $V_{BG}$. The current source comprises field-effect transistors (FET) 138, 140 and 144 and couples to power source $V_{DD}$. The power supply voltage $V_{DD}$ is supplied through FET 138 to node Nr which has a voltage Vr that is equal to $V_{DD}$ reduced by the voltage drop across FET 138. The bandgap voltage reference supply circuit 100 comprises FETs 102, 104 and 106, transistors 108 and 110, and resistors 112 and 114. In order to increase the power supply rejection ratio (PSRR) of the whole circuit, the voltage signal generated by the bandgap voltage reference supply circuit 100 is amplified by a high gain amplifier circuit 120 comprising FETs 122, 124, 126, 128, 130, 132, 134, 136 and capacitor 121. A cascode circuit is used in the high gain amplifier circuit 120.

The bandgap voltage reference circuit disclosed in U.S. Pat. No. 5,512,817 suffers from a high voltage power supply and large chip-area requirement. The circuit shown in PRIOR ART FIG. 1 is provided with the cascode circuit to increase the PSRR with its high amplification capability and to eliminate the fluctuations of $V_{DD}$. Unfortunately, cascode circuits must be connected in series with other reference circuit components between the power supply and ground. Thus, such cascode configuration reduces the voltage headroom available in the circuit.

Another approach in the prior art is to provide a pre-regulated voltage supplied to the bandgap circuit. However, the circuit associated with the pre-regulation voltage consumes more power, chip-area and increases the complexity of the circuit.

Further, in order to generate multiple output reference voltages, the output voltage of the bandgap circuits generally need be buffered by an amplifier to provide power to a voltage divider which generates multiple output reference voltages. An exemplary circuit which includes a unity-gain voltage buffer 250 and a resistor-divider load 252 is shown in PRIOR ART FIG. 2. The resistor-divider load 252 comprising resistors 254, 256 and 258 is coupled between a node 260 where bandgap voltage $V_{BG}$ is outputted and a common node GNDA. Since the bandgap voltage is buffered by the unity-gain voltage buffer 250, the output voltage of the buffer is equal to the input bandgap voltage but the output current drive capability is higher. Thus, it can generate multiple output reference voltages $V_{REF2}$ and $V_{REF3}$ at nodes 262 and 264 as shown in PRIOR ART FIG. 2.

In some applications, outputting reference voltages above the bandage voltage may be desired. To meet this requirement, an alternative exemplary circuit which comprises a voltage buffer 350 and a voltage divider 352 shown in PRIOR ART FIG. 3 may be employed. The voltage buffer 350, resistor 320 and resistor 322 are used to amplify the reference voltage $V_{BG}$ to obtain a voltage higher than the bandage voltage. The voltage divider 352 comprises resistors 354, 356 and 358 for generating multiple reference voltages $V_{REF1}$, $V_{REF2}$ and $V_{REF3}$ at nodes 360, 362 and 364 as shown in PRIOR ART FIG. 3. However, the power and chip area will be further consumed by using the voltage buffer.

Another disadvantage of the bandgap voltage reference circuit shown in PRIOR ART FIG. 1 is the input-referred offset voltage of the high gain amplifier circuit, $V_{OS}$. The effect can be calculated in Equation (1) as follows:

$$V_{BG} = V_{BE110} + N\frac{R_{114}}{R_{112}}\ln[M(N+1)]V_T - N\frac{R_{114}}{R_{112}}V_{OS} \tag{1}$$

Where M is the ratio of the sizes of transistors 108 and 110, N is the ratio of the sizes of FETs 106 and 104, and $V_{BE110}$ is the base-emitter voltage of the transistor 110. As shown in Equation (1), the offset voltage $V_{OS}$ is amplified, and thus error may be introduced into the bandgap voltage $V_{BG}$. More importantly, the input-referred offset voltage $V_{OS}$ varies with temperature, and raises the temperature coefficient of the output voltage. In order to lower the effect of the input-referred offset voltage, the high gain amplifier needs to incorporate large devices in a carefully chosen topology so as to minimize the offset. Thus, the chip area requirement is further increased.

SUMMARY OF THE INVENTION

It is an object of the present invention to provide a circuit and a method for generating different reference voltages with high power supply rejection ratio.

In order to achieve the above object, the present invention provides a voltage generator for generating a voltage reference with high power supply rejection ratio which requires considerably smaller chip area than bandgap voltage reference circuits of the prior art. The voltage generator comprises a voltage regulator and a bandgap voltage circuit and an amplifier. The voltage regulator having an input node is used to generate a regulated voltage source for the bandgap voltage circuit. The bandgap voltage circuit comprises a first resistor and a second resistor and a first and a second transistor. The first transistor is coupled to the regulated voltage source and the first resistor is coupled to the first transistor. The second transistor coupled to the first resistor, the first transistor and the regulated voltage source so as to generate a voltage difference between the base-to-emitter voltage of the first transistor and the base-to-emitter voltage of the second transistor. The second resistor is coupled to the first resistor and the first transistor for generating the first predetermined voltage in response to the voltage difference. An amplifier coupled to the bandgap voltage circuit is used to generate an amplified signal in response to an amplifying signal from the bandgap voltage circuit. The amplified signal is transmitted to the input node of the voltage regulator to regulate the regulated voltage source.

BRIEF DESCRIPTION OF THE DRAWINGS

Other objects, advantages, and novel features of the invention will become more apparent from the following detailed description when taken in conjunction with the accompanying drawing.

PRIOR ART

PRIOR ART

PRIOR ART

DESCRIPTION OF THE EMBODIMENT

Reference will now be made in detail to the embodiments of the present invention, low power bandgap voltage reference circuit with high power supply rejection ratio and being capable of generating multiple reference voltages without using any buffer. While the invention will be described in conjunction with the embodiments, it will be understood that they are not intended to limit the invention to these embodiments. On the contrary, the invention is intended to cover alternatives, modifications and equivalents, which may be included within the spirit and scope of the invention as defined by the appended claims.

Furthermore, in the following detailed description of the present invention, numerous specific details are set forth in order to provide a thorough understanding of the present invention. However, it will be recognized by one of ordinary skill in the art that the present invention may be practiced without these specific details. In other instances, well known methods, procedures, components, and circuits have not been described in detail as not to unnecessarily obscure aspects of the present invention.

Figure 1:
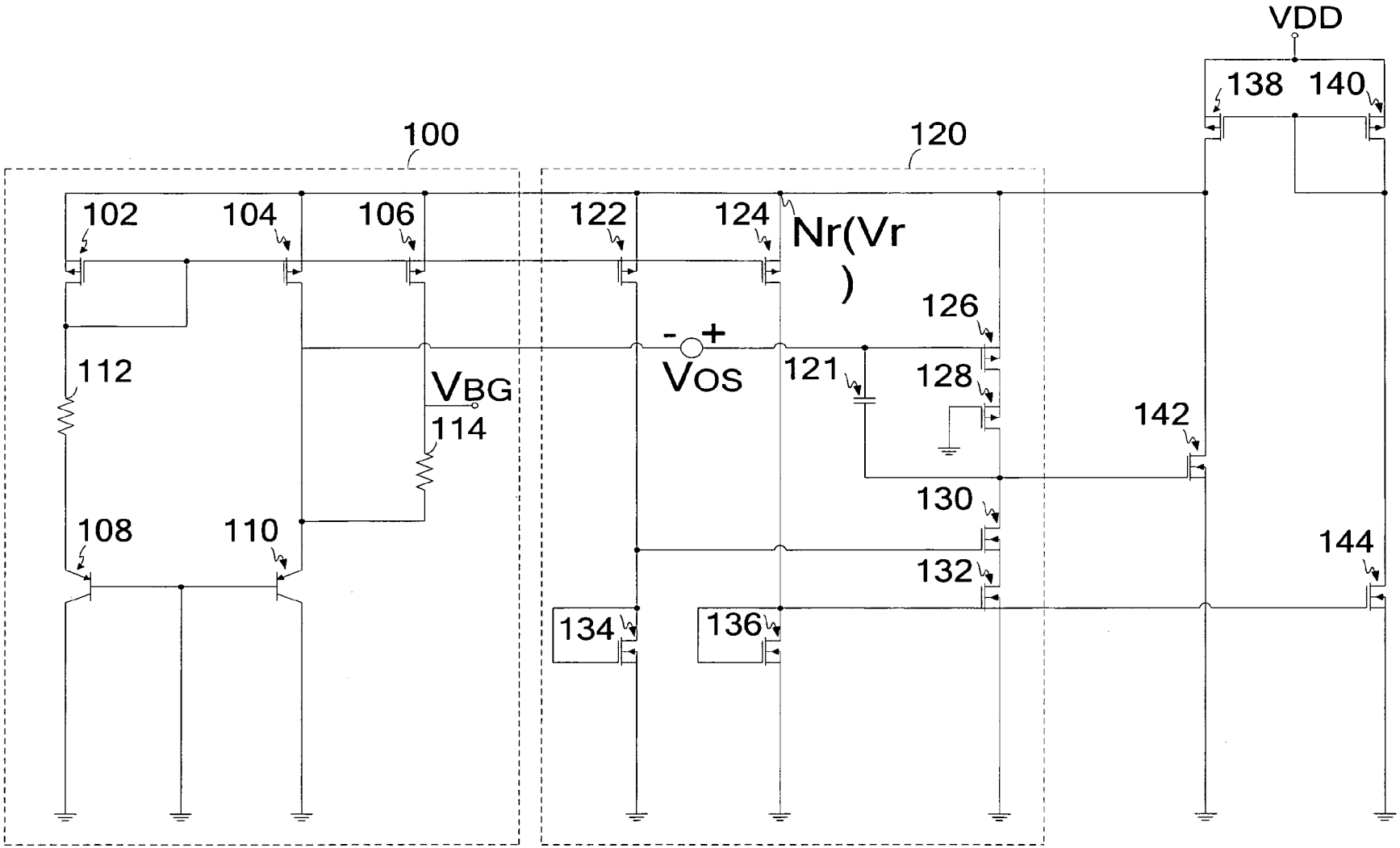
FIG. 1 PRIOR ART
FIG. 1 is a schematic diagram showing a bandgap voltage reference circuit of the prior art.
Figure 2:
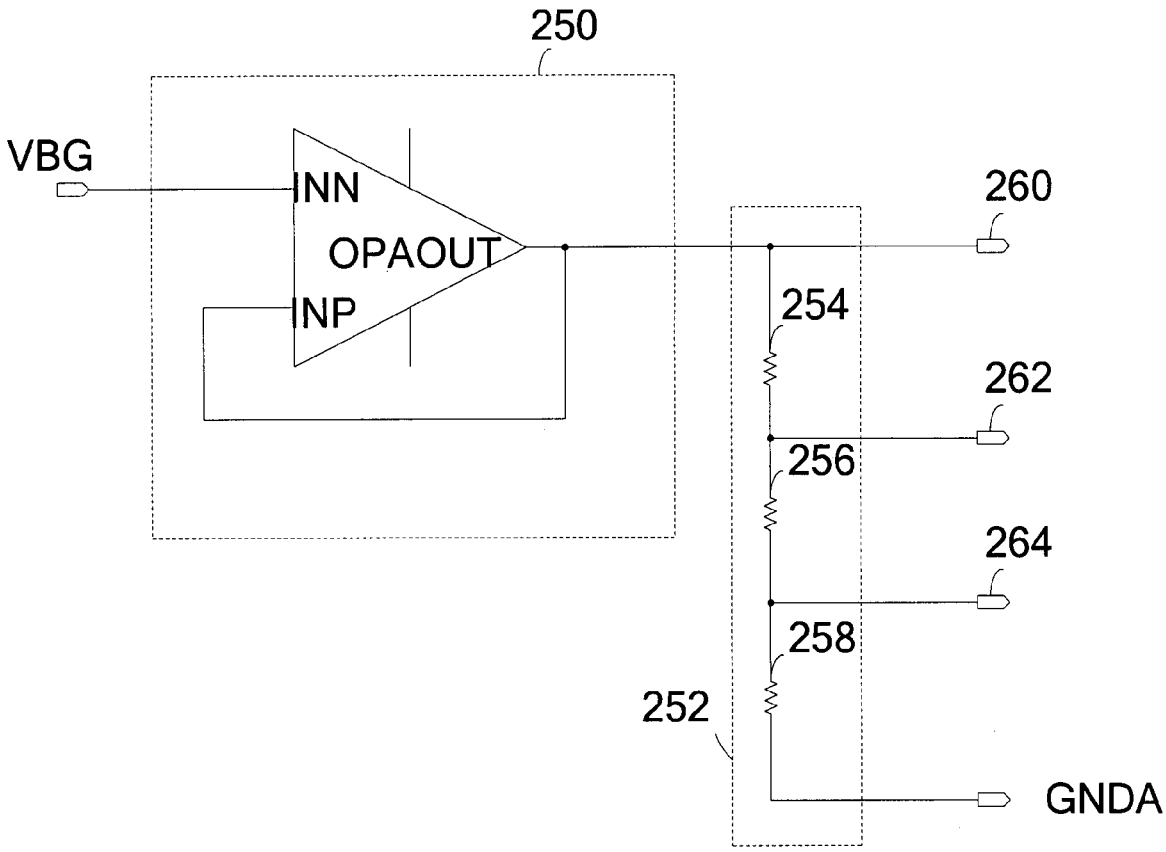
FIG. 2 PRIOR ART
FIG. 2 is a schematic diagram showing a circuit which is employed for generating multiple output voltages lower than the bandgap voltage according to FIG. 1 of the prior art.
Figure 3:
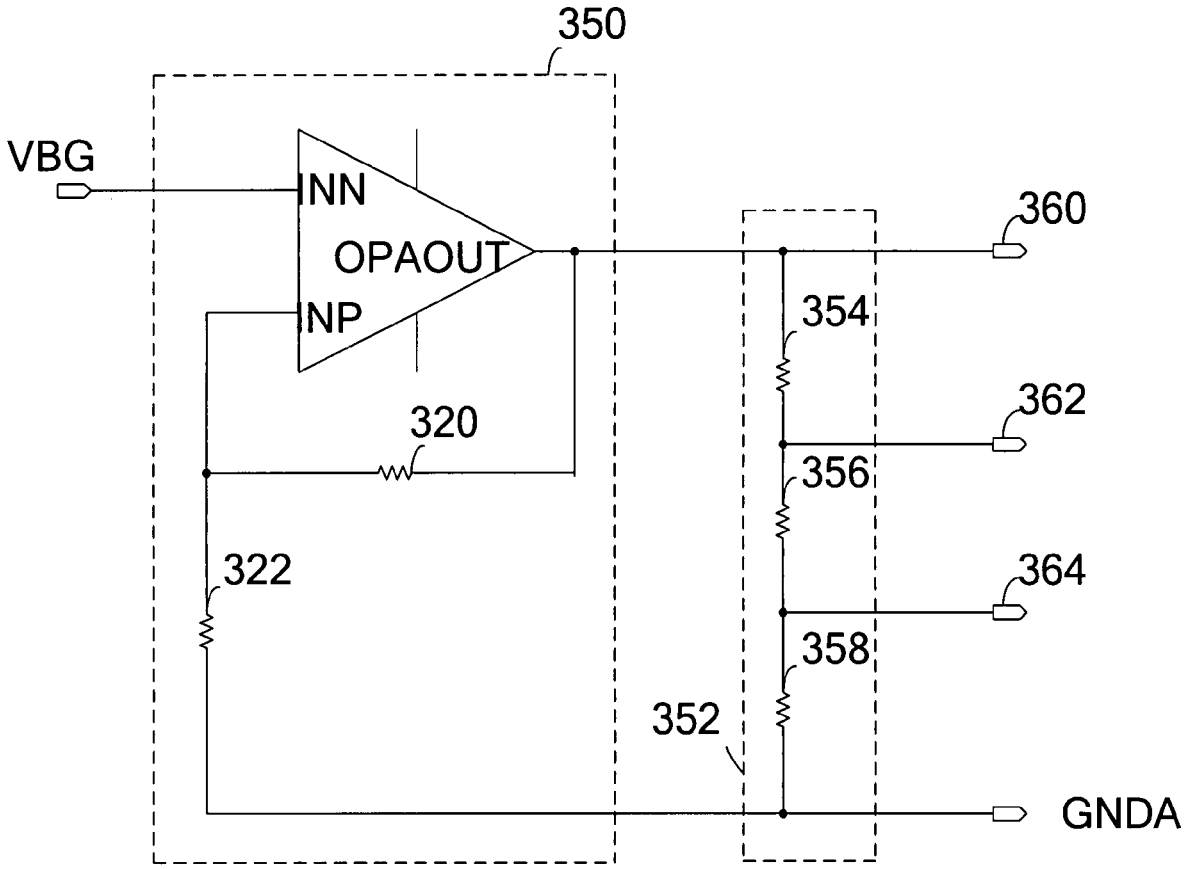
FIG. 3 PRIOR ART
FIG. 3 is a schematic diagram showing a circuit which is employed for generating multiple output voltages higher than the bandgap voltage according to FIG. 1 of the prior art.
Figure 4:
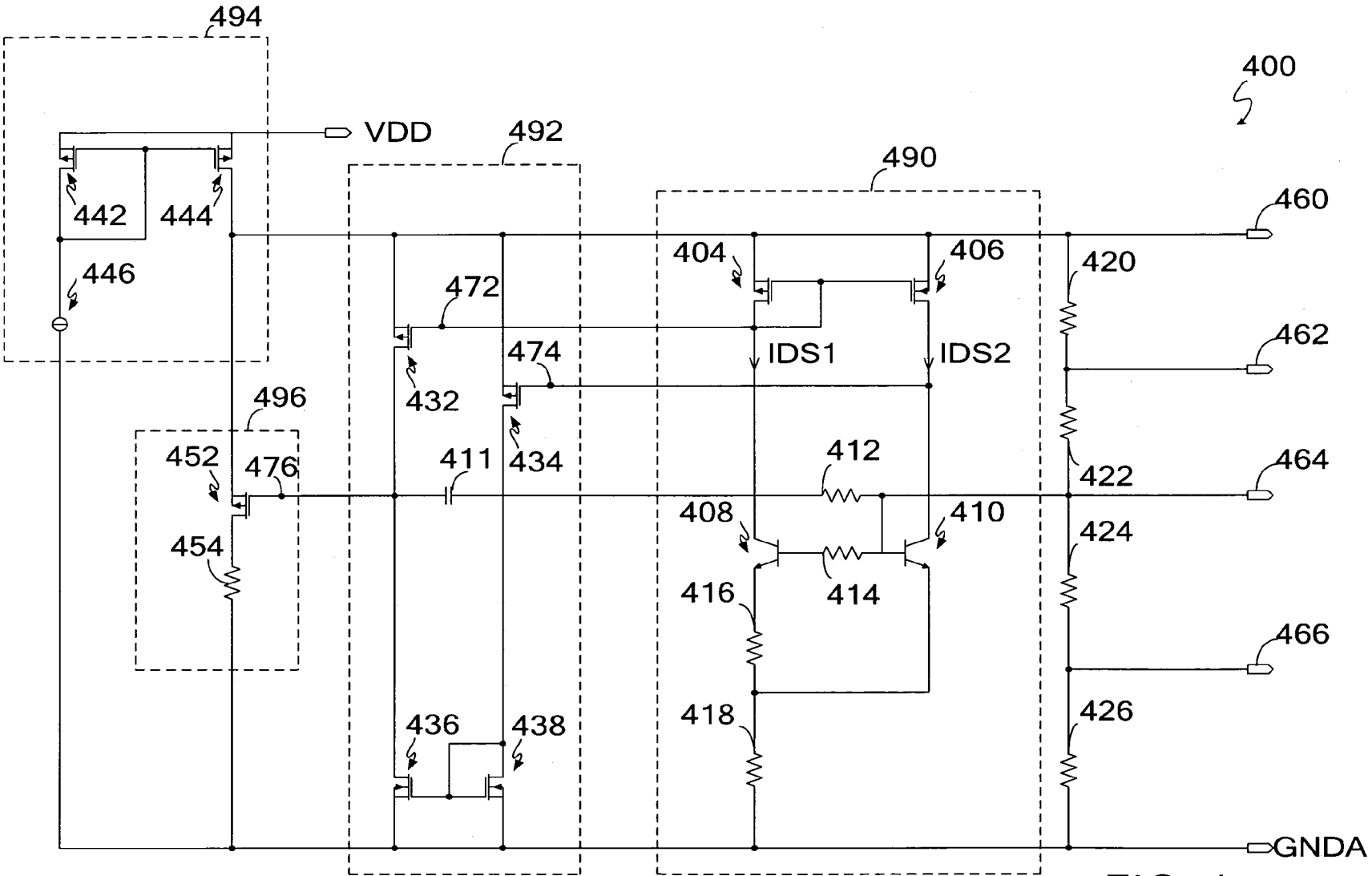
FIG. 4 is a schematic diagram of the voltage generator in accordance with one embodiment of the present invention.

FIG. 4 shows a voltage generator 400 in accordance with one embodiment of the present invention. The voltage generator 400 comprises a voltage source current mirror 494, a voltage regulator 496, an amplifier circuit 492, a bandgap voltage reference 490, resistors 420, 422, 424, 426, a compensation capacitor 411 and a compensation resistor 412.

An external power supply, $V_{DD}$, is coupled to the voltage source current mirror 494 for supplying electric power and voltage to the voltage source current mirror 494 of the voltage generator 400. The voltage source current mirror 494 comprises a current source 446, field-effect transistors (FET) 442 and 444. The FETs 442 and 444 are coupled with each other to serve as a current mirror, and the FET 444 is coupled to the voltage regulator 496 for generating a regulated voltage source $V_{REG}$ at node 460 and isolating the bandgap voltage circuit 490 from the external power supply. The current source 446 provides biased current for the current mirror. The separation from the external power supply can reduce susceptibility of the bandgap voltage circuit 490 from variations and noise in the external power supply $V_{DD}$, therefore improving the PSRR performance of the bandgap voltage circuit 490.

The bandgap voltage reference circuit 490 is formed by the current loop comprising FETs 404 and 406, transistors 408 and 410, resistors 414, 416 and 418. The FETs 404, 406 which are substantially matched with each other are coupled as a current mirror to supply currents IDS1, IDS2 to nodes 472 and 474, respectively. Thus, the currents IDS1 and IDS2 are substantially equal in order to obtain the bandgap voltage which will be discussed in detail below. Current IDS1 passes through the transistor 408 and the resistor 416 while current IDS2 passes through the transistor 410, and then currents IDS1 and IDS2 together pass through the resistor 418. A voltage difference $\Delta V_{BE}$ between the base-to-emitter voltage $V_{BE410}$ of transistor 410 and the base-to-emitter voltage $V_{BE408}$ of transistor 408 equals to a voltage $V_{R416}$ across resistor 416. Thus, the voltage $V_{R416}$ and the voltage difference $\Delta V_{BE}$ can be calculated in Equation (2) as follows:

$$V_{R416}=\Delta V_{BE}=V_T ln(Q_{B408}/Q_{B410}) \quad (2)$$

where $Q_{B408}$ is size of transistor 408, $Q_{B410}$ is size of transistor 410 and $V_T$ is thermal voltage which can be calculated in Equation (3) as follows:

$$V_T=k\cdot T/q \quad (3).$$

Where K is Boltzmann's constant, T is the temperature in degrees Kelvin, q is the electrical charge of an electron.

The ratio of $Q_{B408}$ to $Q_{B410}$ is given as a constant M, thus, the voltage across the resistor 416 can be further calculated in Equation (4) as follows:

$$V_{R416}=\Delta V_{BE}=V_T ln(M) \quad (4)$$

Note that the thermal voltage $V_T$ is proportional to absolute temperature, i.e., it has a positive linear temperature coefficient. Thus, the voltage difference $V_{R416}$ is also proportional to absolute temperature.

Since the current IDS1 through resistor 416 is proportional to the voltage $V_{R416}$, the current IDS1 is also dependent on absolute temperature. As mentioned above, the current mirror formed by the FETs 404 and 406 assures that the current IDS1 is substantially the same as the current IDS2. Consequently, the currents IDS1 and IDS2 are proportional-to-absolute-temperature (PTAT) currents which can be calculated in Equation (5) as follows:

$$IDS1=IDS2=V_{416}/R_{416}=V_T ln(M)/R_{416} \quad (5)$$

where $R_{416}$ is the resistance of the resistor 416.

As mentioned above, currents IDS1 and IDS2 together pass through resistor 418 to generate a voltage, so the current flowing through resistor 418 is twice as much as the current IDS1 or IDS2. Thus, the voltage across the resistor 418 can be calculated in Equation (6) as follows:

$$V_{R418} = 2\frac{R_{418}}{R_{416}}V_T\ln(M) \quad (6)$$

where $R_{418}$ is the resistance of resistor 418. The voltage $V_{R418}$ is also dependent to absolute temperature. The bandgap reference voltage $V_{BG}$ at the node 464 is equal to the voltage across the resistor 418 plus the base-to-emitter voltage of the transistor 410, $V_{BE410}$, which is the forward biased PN junction voltage, and thus can be calculated in the following Equation (7):

$$V_{BG} = 2\frac{R_{418}}{R_{416}}V_T\ln(M) + V_{BE410} \quad (7)$$

In Equation (7), it should be noted that the temperature coefficients of resistances $R_{418}$ and $R_{416}$ are cancelled by dividing. As a result, the temperature coefficient of the bandgap voltage $V_{BG}$ is dependent only on the thermal voltage and the voltage $V_{BE410}$. In other words, the bandgap voltage $V_{BG}$ is realized by the positive temperature coefficient of the thermal voltage $V_T$ plus the negative temperature coefficient of the PN junction voltage $V_{BE410}$.

Those skilled in the art will recognize this bandgap circuit is known as a Brokaw bandgap reference circuit, which is a voltage reference circuit widely used in integrated circuits.

Fluctuations or variations in the voltage of the power supply, $V_{DD}$, are not resulted in fluctuations in the output bandgap voltage, $V_{BG}$, by using a feedback mechanism which will be described in more detail below. The feedback mechanism includes the amplifier circuit 492 which controls or regulates the voltage regulator 496 and then controls or regulates the regulated voltage $V_{REG}$.

The voltage regulator 496 comprises FET 452, resistor 454 and an input node 476. The input node 476 of the voltage regulator 496 is coupled to the output node of the amplifier circuit 492. The source of FET 452 is coupled to the node 460, and the gate of FET 452 is coupled to the input node 476. Thus, the FET 452 provides a drain current from the output node 460 to ground in response to the amplified voltage signal from the amplifier circuit 492. Compensation capacitor 411 and resistor 412 are used to control the open-loop crossover frequency and stabilize the close-loop response.

According to one embodiment of present invention, the amplifier circuit 492 is a differential amplifier comprising FETs 432, 434, 436 and 438. The FETs 432 and 434 are coupled to each other to serve as a differential pair for sensing the difference between the voltages at the drains of the FETs 404 and 406. Further, in one embodiment, the FETs 432 and 434 are chosen to have substantially the same sizes as the FETs 404 and 406. The FETs 436 and 438 are coupled to each other to serve as a current mirror which acts as an active load and thus the drain current of the FET 436 mirrors the drain current of the FET 434. Signal of the voltage difference between the voltages on the drains of the FETs 404 and 406 is amplified. Thus, a differential-input, single-ended-output gain stage is realized. The amplifier circuit 492 coupled to the drains of the FETs 404 and 406, in other words, the bandgap voltage circuit 490 and the amplifier circuit 492 shares a same stage input.

Those skilled in the art will recognize that, in another embodiment, a single-ended input also can be used. In this embodiment, one of nodes 472 and 474 coupled to one of the drains of FETs 404 and 406, and the other node is coupled to ground.

For providing a feedback loop and further obtaining multiple output reference voltages, a plurality of resistors 420, 422, 424 and 426 are employed. In the voltage generator 400 according to one embodiment of the present invention shown in FIG. 4, the resistors 420 and 422 are coupled to each other in series for coupling the output node 460 to the output node 464. The resistors 424 and 426 are coupled to each other in series for coupling the output node 464 to ground. By means of the resistors 420, 422, 424 and 426, the regulated voltage $V_{REG}$ will be further stabilized. The regulated voltage $V_{REG}$ is higher than the bandgap voltage $V_{BG}$. The resistors 420 and 422 act as a voltage divider, and a reference voltage $V_{REF2}$ higher than bandgap voltage $V_{BG}$ can be obtained at the node 462 between resistor 420 and resistor 422. Similarly, a reference voltage $V_{REF1}$ lower than bandgap voltage $V_{BG}$ can be obtained at the node 466 between resistor 424 and resistor 426

Thus, multiple output reference voltages can be generated without using any voltage buffer. Without voltage buffer, the power consumption of the whole circuit will not be significantly increased. While exemplary threshold voltage Vth of the FETs 432, 434, 404 and 406 is 1.0 Volt, the minimum operating voltage of the bandgap voltage circuit 490 is approximately 2.0 Volts. In practice, the bandgap voltage circuit 490 can be operated with extremely low power source, $V_{DD}$, such as 2.3 Volts. Compared with the cascode configuration of the prior art, the present invention provide higher voltage headroom when using same power source.

Furthermore, since the bandgap voltage $V_{BG}$ at node 464 is coupled to the regulated voltage $V_{REG}$, the regulated voltage $V_{REG}$ can be expressed in Equation (8) as follows:

$$V_{REG} = \frac{R_{420} + R_{422} + R_{424} + R_{426}}{R_{424} + R_{426}} \cdot V_{BG} \quad (8)$$

where $R_{420}$, $R_{422}$, $R_{424}$, and $R_{426}$ are the resistances of resistors 420, 422, 424, and 426, respectively. In this embodiment, the regulated voltage $V_{REG}$ at the node 460 can also be used as a stable voltage reference that is immune to temperature and power supply variations.

By adding the resistors, the base currents of transistors 408 and 410 flows through resistors 420 and 422. This current may require an increase above the nominal output voltage to bring the base of transistor 410 to the proper level. Resistor 414 is added to compensate this effect.

In operation, if there is a variation, $\Delta V_{REG}$, in the voltage at node 460, for example, caused by the fluctuation in the power source $V_{DD}$, or by any other reasons, the voltage variation $\Delta V_{REG}$ results directly in a variation of the base voltage of transistor 410 at node 464 such that the voltage at node 474 is varied. The voltage variation at node 474 is amplified through the amplifier circuit 492 formed by the FETs 432, 434, 436 and 438 to the node 476 which is coupled to the gate of the FET 452 so as to vary or compensate the voltage at node 460.

The effect of a voltage variation, $\Delta V_{REG}$, at node 460 can also be calculated in Equation (9) as follows:

$$\Delta V_{BG} = \frac{R_{424} + R_{426}}{R_{420} + R_{420} + R_{424} + R_{426}} \cdot \Delta V_{REG} \tag{9}$$

Where $\Delta V_{REG}$ is the voltage variation at node 460, and $\Delta V_{BG}$ is the voltage variation of the base of the transistor 410 at node 464. The voltage variation at node 464, $\Delta V_{BG}$, is amplified through the transistor 410 and the FET 406. Thus, the voltage variation, $\Delta V_{INP}$, at node 474 which has been amplified can be calculated in Equation (10) as follows:

$$\Delta V_{INP} = -\Delta V_{BG} \cdot A_{bgr} \tag{10}$$

Where $A_{bgr}$ is the gain of the bandgap voltage circuit 490, and can be calculated in Equation (11) as follows:

$$A_{bgr} = g_{m_410} \cdot R_{INP} \tag{11}$$

Where $g_{m_410}$ is the trans-conductance of transistor 410; $R_{INP}$ is the parasitic resistance at node 474. Thus, the voltage variation at node 474, $\Delta V_{INP}$, can be calculated in Equation (12) as follows:

$$\Delta V_{INP} = -\frac{R_{424} + R_{426}}{R_{420} + R_{422} + R_{424} + R_{426}} \cdot \Delta V_{REG} \cdot g_{m_410} \cdot R_{INP} \tag{12}$$

As described hereinbefore, the voltage variation at the node 474, $\Delta V_{INP}$, is amplified by the amplifier circuit 492. So the voltage change $\Delta V_{AMPOUT}$ at the node 476 can be calculated in Equation (13) as follows:

$$\Delta V_{AMPOUT} = \Delta V_{INP} \cdot A_{amp} \tag{13}$$

Where $A_{amp}$ is the gain of the amplifier circuit 492 and it can be calculated in Equation (14) as follows:

$$A_{amp} = g_{m_432} \cdot R_{AMP} \tag{14}$$

Where $g_{m_432}$ is the trans-conductance of the FET 432; $R_{AMP}$ is the parasitic resistance at node 476. Summing up the Equations (12), (13) and (14), the voltage va0iation$\Delta V_{AMPOUT}$ at the node 476 can also be calculated in Equation (15) as follows:

$$\Delta V_{AMPOUT} = -\frac{R_{424} + R_{426}}{R_{420} + R_{422} + R_{424} + R_{426}} \cdot g_{m_410} \cdot R_{INP} \cdot g_{m_432} \cdot R_{AMP} \tag{15}$$

Assume that the gain of the voltage regulator 496 as a source follower is approximately equal to unity, the loop gain LG of the whole circuit can be calculated in Equation (16) as follows:

$$LG = \Delta V_{AMPOUT} / \Delta V_{REG} = -\frac{R_{424} + R_{426}}{R_{420} + R_{422} + R_{424} + R_{426}} \cdot g_{m_410} \cdot R_{INP} \cdot g_{m_432} \cdot R_{AMP} \tag{16}$$

In practice, the loop gain is typically 60 to 80 decibels, indicating that a voltage variation at node 460, will be degraded greatly and quickly by the loop gain. As a result, the present invention provides a high rejection of any variations in the voltages $V_{REG}$, $V_{REG1}$, $V_{BG}$ and $V_{REG2}$ at nodes 460, 462, 464 and 466, caused by fluctuations in the power source, $V_{DD}$, or by other sources. From Equation (15), it can be seen that the loop gain is mainly from the gain of the bandgap voltage circuit 490, $A_{bgr}$, and the gain of the amplifier circuit 492, $A_{amp}$. Since the bandgap voltage circuit 490 has contributed a portion of the overall loop gain, typically 30 to 40 decibels, the amplifier circuit 492 is enough for obtain a high loop gain of the whole circuit. As a result, it can be avoided to employ any cascode configuration which significantly increases power consumption. Thus, the smaller chip area can be achieved according the embodiment of the present invention.

Further, it will be apparent to those skilled in the art, the error of the input-referred offset voltage of the amplifier circuit 492 will be negligible. Therefore, the high gain amplifier need not incorporate large chip-area devices to minimize the offset voltage.

Figure 5:
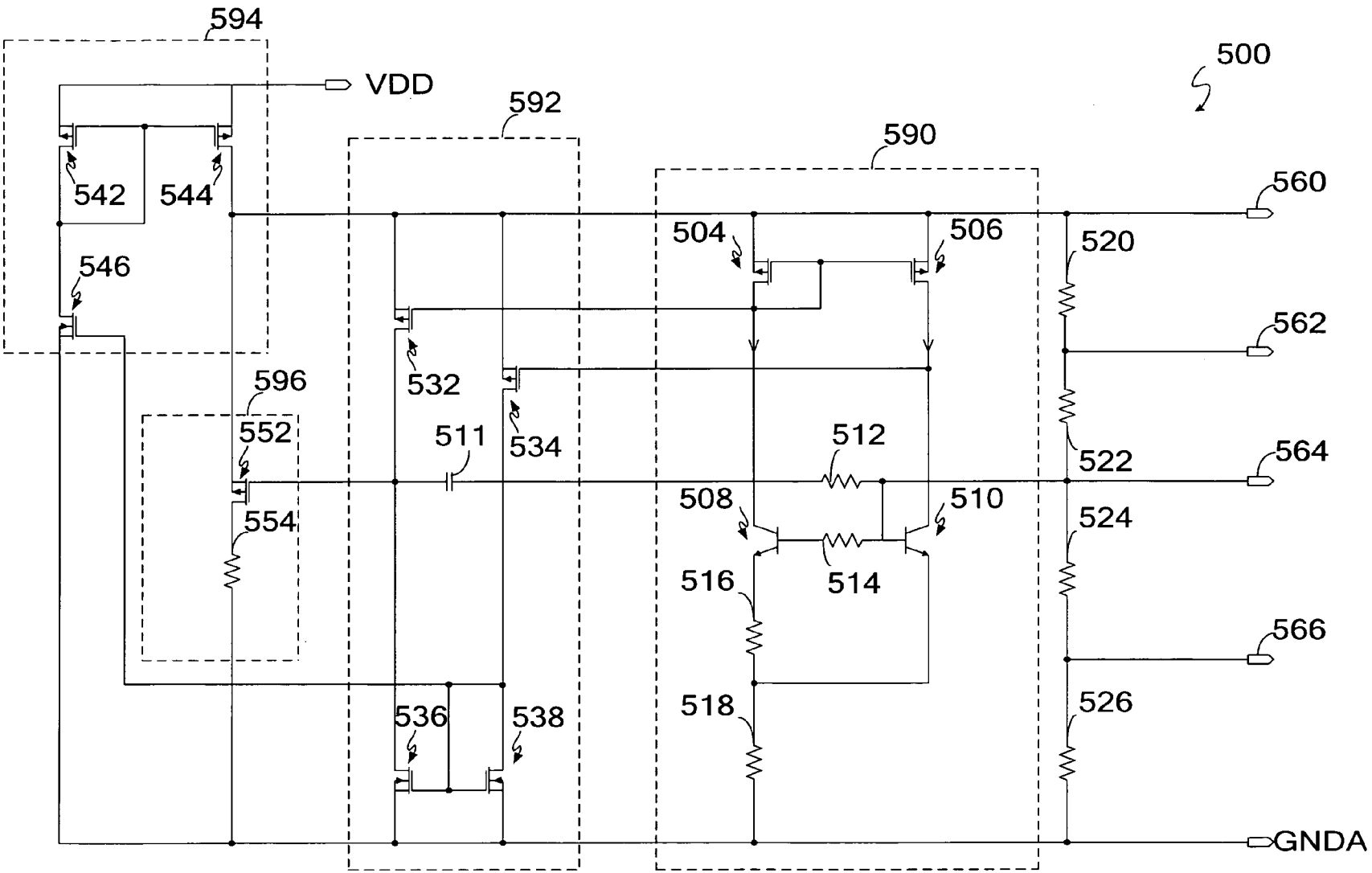
FIG. 5 is a schematic diagram of the voltage generator in accordance with another embodiment of the present invention.

FIG. 5 shows a voltage generator 500 according to another embodiment of the present invention is illustrated. The voltage generator 500 is similar to the voltage generator 400 shown in FIG. 4. For purposes of clarity, the elements of the voltage generator 500 which are similar to the elements of the voltage generator 400 shown in FIG. 4 will not be described in detail. The voltage generator 500 comprises a voltage source current mirror 594, a voltage regulator 596, an amplifier circuit 592, a bandgap voltage reference 590, resistors 520, 522, 524, 526, a compensation capacitor 511 and a compensation resistor 512. In this embodiment, the voltage source current mirror 594 comprises a FET 546. The FET 546 is coupled to the bases of FETs 536 and 538 of the amplifier circuit 592 for providing biased current for the current mirror formed by FETs 542 and 544 of the voltage source current mirror 594, and the FET 546 is self-biased.

Figure 6:
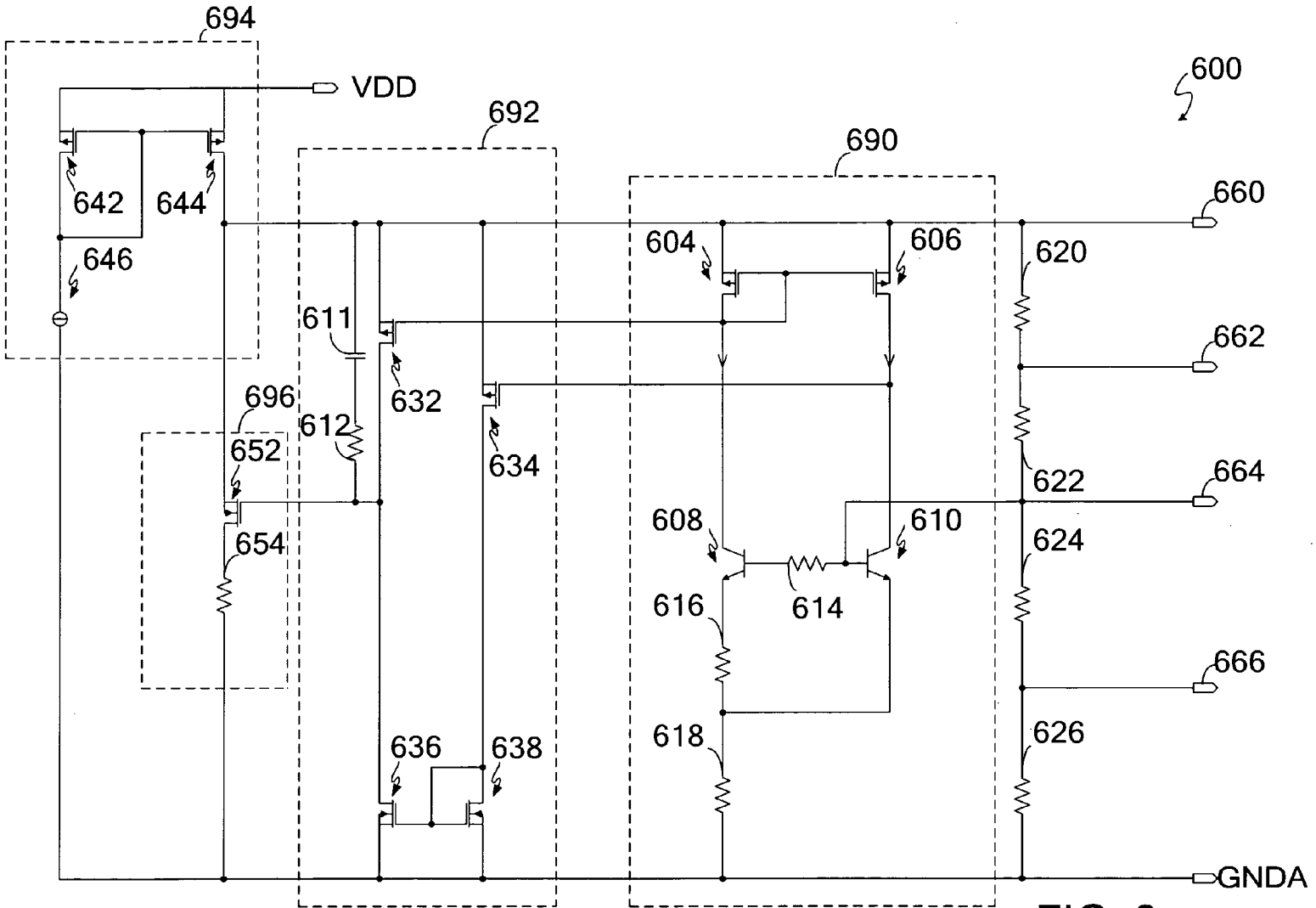
FIG. 6 is a schematic diagram of the voltage generator in accordance with another embodiment of the present invention.

FIG. 6 shows a voltage generator 600 according to another embodiment of the present invention is illustrated. The voltage generator 600 is similar to the voltage generator 400 shown in FIG. 4. For purposes of clarity, the elements of the voltage generator 600 which are similar to the elements of the voltage generator 400 shown in FIG. 4 will not be described in detail. The voltage generator 600 comprises a voltage source current mirror 694, a voltage regulator 696, an amplifier circuit 692, a bandgap voltage reference 690, resistors 620, 622, 624, 626, a compensation capacitor 611 and a compensation resistor 612. In contrast to the voltage generator 400 shown in FIG. 4, an N-type FET 652 is used in the voltage regulator 696. The compensation capacitor 611 and the compensation resistor 612 are coupled in series to the gate of FET 652 and the node 660 where regulated voltage $V_{REG}$ is outputted. The compensation capacitor 611 and resistor 612 are used to control the open-loop crossover frequency and stabilize the close-loop response.

Figure 7:
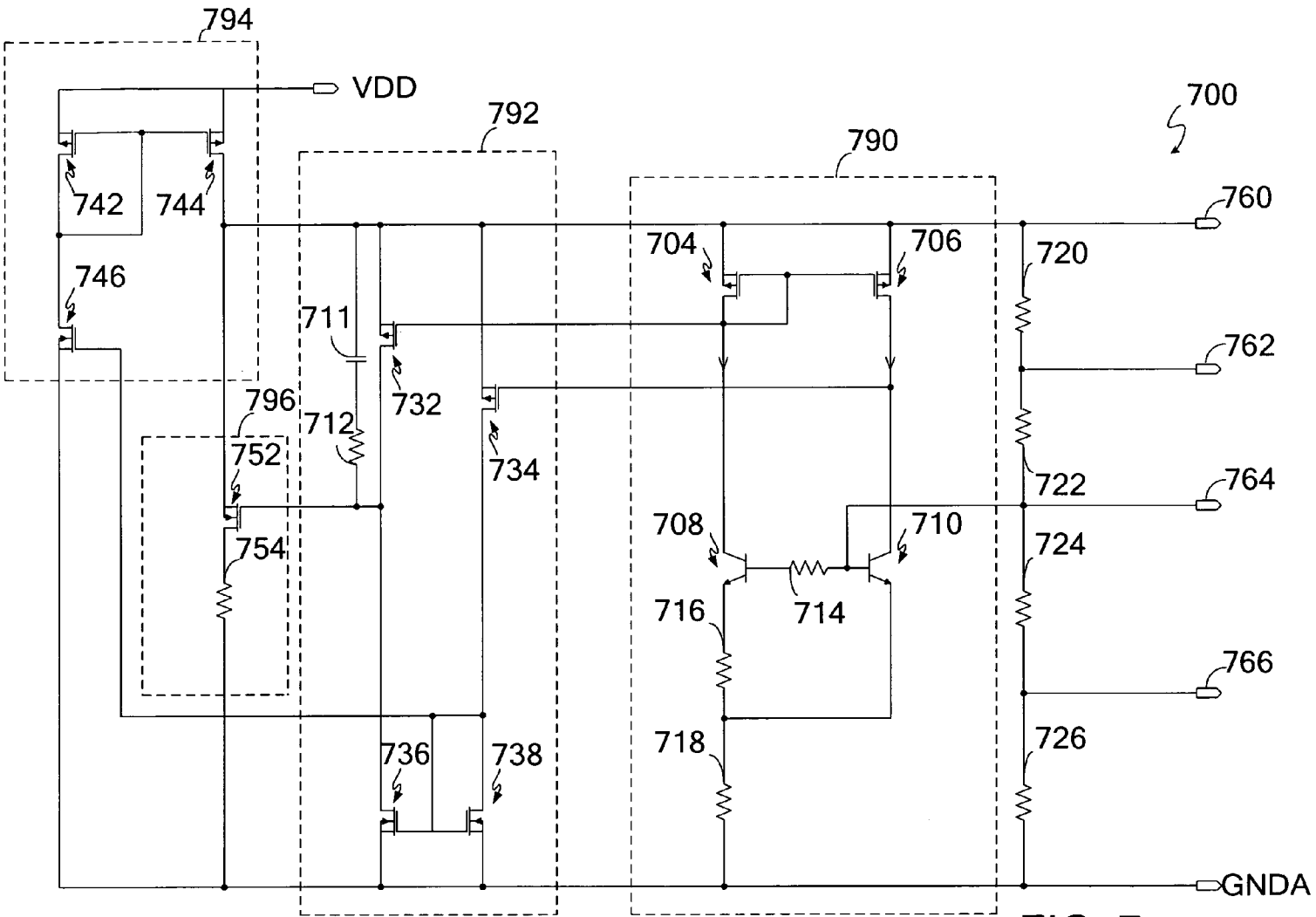
FIG. 7 is a schematic diagram of the voltage generator in accordance with another embodiment of the present invention.

FIG. 7 shows a voltage generator 700 according to another embodiment of the present invention is illustrated. The voltage generator 700 is similar to the voltage generator 500 shown in FIG. 5. For purposes of clarity, the elements of the voltage generator 700 which are similar to the elements of the voltage generator 400 shown in FIG. 5 will not be described in detail. The voltage generator 700 comprises a voltage source current mirror 794, a voltage regulator 796, an amplifier circuit 792, a bandgap voltage reference 790, resistors 720, 722, 724, 726, a compensation capacitor 711 and a compensation resistor 712. Similar to the voltage generator 500 shown in FIG. 5, the voltage source current mirror 794 comprises a self-biased FET 746 coupled to the bases of FETs 736 and 738 for providing biased current for the current mirror of the voltage source current mirror 794. An N-type FET 752 is used in the voltage regulator 796. The compensation capacitor 711 and the compensation resistor 712 are coupled in series to the gate of an N-type FET 752 and the node 760 where regulated voltage $V_{REG}$ is outputted.

While the foregoing description and drawings represent the embodiments of the present invention, it will be understood that various additions, modifications and substitutions may be made therein without departing from the spirit and scope of the principles of the present invention as defined in the accompanying claims. For example, although P-channel FETs and PNP bipolar transistors are used in the voltage generator 400 shown FIG. 4, it is understood that the P-channel FETs can be replaced by N-channel FETs and NPN bipolar transistors can be substituted for PNP transistors. In addition, although a conventional current mirror is shown, it is understood that another type of current mirror could be used, such as Wilson current mirrors. One skilled in the art will appreciate that the invention may be used with many modifications of form, structure, arrangement, proportions, materials, elements, and components and otherwise, used in the practice of the invention, which are particularly adapted to specific environments and operative requirements without departing from the principles of the present invention. The presently disclosed embodiments are therefore to be considered in all respects as illustrative and not restrictive, the scope of the invention being indicated by the appended claims and their legal equivalents, and not limited to the foregoing description.

What is claimed is:

1. A voltage reference generator for providing a predetermined voltage reference, comprising:
- a voltage regulator coupled to an external power supply for generating a regulated voltage source comprising an input node;
- a bandgap voltage circuit comprising:
  - a first transistor coupled to said regulated voltage source;
  - a first resistor coupled to said first transistor;
  - a second transistor coupled to said first resistor, said first transistor and said regulated voltage source so as to generate a voltage difference between the base-to-emitter voltage of said first transistor and the base-to-emitter voltage of said second transistor; and
  - a second resistor coupled to said first resistor and said first transistor for generating said predetermined voltage in response to said voltage difference; and
- an amplifier circuit coupled to said second transistor of said bandgap voltage circuit for receiving a first amplifying signal so as to generate an amplified signal in response to said first amplifying signal, wherein said amplified signal is transmitted to said input node of said voltage regulator to regulate said regulated voltage source.

2. The voltage reference generator of claim 1, wherein said bandgap voltage circuit further comprises:
- a current mirror coupled to said regulated voltage source for providing a first current for said first transistor and a second current for said second transistor.

3. The voltage reference generator of claim 1, wherein said amplifier circuit is a differential amplifier circuit.

4. The voltage reference generator of claim 3, wherein said differential amplifier circuit is further coupled to said first transistor for receiving a second amplifying signal so as to generate said amplified signal in response to said first and said second amplifying signals.

5. The voltage reference generator of claim 1, further comprising:
- a voltage source current mirror coupled to said external power supply and said voltage regulator such that said regulated voltage source of said voltage regulator is generated in response to an output of said voltage source current mirror.

6. The voltage reference generator of claim 5, wherein said voltage source current mirror is self-biased.

7. The voltage reference generator of claim 1, wherein said bandgap voltage circuit further comprises:
- a third resistor coupled to said first transistor and said second transistor for compensating the effect of the base currents of said first and second transistors.

8. The voltage reference generator of claim 1, further comprising:
- a plurality of resistors coupled between said regulated voltage source and said predetermined voltage reference for generating at least one voltage reference higher than said predetermined voltage reference.

9. The voltage reference generator of claim 1, further comprising:
- a plurality of resistors coupled between said predetermined voltage and ground reference for generating at least one voltage reference lower than said predetermined voltage reference.

10. The voltage reference generator of claim 1, further comprising: a compensation capacitor and a compensation resistor coupled to said input node of said voltage regulator in series.

11. A voltage reference generator, comprising:
- a voltage regulator circuit coupled to an external power supply for generating an regulated voltage;
- a bandgap voltage reference circuit coupled to said voltage regulator circuit for receiving said regulated voltage and generating a first reference voltage;
- an amplifier circuit coupled to said bandgap voltage reference circuit and coupled to said voltage regulator circuit for stabilizing said regulated voltage; and
- a first voltage divider coupled between said regulated voltage and said first reference voltage for generating a second reference voltage higher than said first reference voltage.

12. The voltage reference generator as claimed in claim 11, wherein said first voltage divider comprises two resistors for generating said second reference voltage at a node between said two resistors.

13. The bandgap voltage reference circuit as claimed in claim 11, further comprising:
- a second voltage divider coupled between said first reference voltage and ground for generating a third reference voltage lower than said first reference voltage.

14. The voltage reference generator as claimed in claim 13, wherein said second voltage divider comprises two resistors for generating said third reference voltage at a node between said two resistors.

15. The voltage reference generator of claim 11, wherein said bandgap voltage reference circuit comprises:
- a first transistor coupled to said regulated voltage;
- a first resistor coupled to said first transistor;
- a second transistor coupled to said first resistor, said first transistor and said regulated voltage so as to generate a voltage difference between the base-to-emitter voltage of said first transistor and the base-to-emitter voltage of said second transistor; and a second resistor coupled to said first resistor and said first transistor for generating said voltage reference in response to said voltage difference.

16. The bandgap voltage reference circuit as claimed in claim 15, wherein said amplifier circuit is a differential amplifier which comprises two inputs coupled to said first transistor and said second transistor.

17. The bandgap voltage reference circuit as claimed in claim 15, further comprising:

a current mirror coupled to said regulated voltage for providing a first current for said first transistor and a second current for said second transistor

18. The voltage reference generator of claim 11, further comprising: a voltage source current mirror coupled to said external power supply for generating a current flowing through said voltage regulator circuit so as to generating said regulated voltage.

19. A method for providing a plurality of reference voltages, comprising:

regulating an external power supply to generate a regulated voltage;

generating a first reference voltage by means of a bandgap voltage circuit coupled to said regulated voltage;

generating a second reference voltage by means of a voltage divider coupled between said regulated voltage and said first reference voltage;

amplifying a signal from said bandgap voltage circuit to generate a regulating signal; and feedback controlling said regulated voltage in response to said regulating signal.

* * * * *